United States Patent [19]

Strauss

[11] Patent Number: 4,677,997

[45] Date of Patent: Jul. 7, 1987

[54] HIGH PRESSURE REVOLVING SEWER CLEANING NOZZLE

[76] Inventor: John W. Strauss, 6366 Winter Dr., Canton, Mich. 48187

[21] Appl. No.: 803,566

[22] Filed: Dec. 2, 1985

[51] Int. Cl.[4] ..... B08B 9/04

[52] U.S. Cl. ..... 134/167 C; 15/104.12; 239/DIG. 13; 239/246; 239/747

[58] Field of Search ..... 134/166 C, 167 C, 168 C; 4/255, 256, 257; 15/104.12; 239/DIG. 13, 245, 246, 743, 744, 747

[56] References Cited

U.S. PATENT DOCUMENTS

| | | | |
|---|---|---|---|
| 2,336,293 | 12/1943 | Pletcher | 15/104.12 |
| 4,073,302 | 2/1978 | Jones | 134/167 C |

FOREIGN PATENT DOCUMENTS

| | | | |
|---|---|---|---|
| 2404474 | 6/1979 | France | 134/167 C |
| 328018 | 4/1930 | United Kingdom | 239/246 |
| 647415 | 2/1979 | U.S.S.R. | 134/167 C |

*Primary Examiner*—Philip R. Coe
*Attorney, Agent, or Firm*—Robert G. Mentag

[57] ABSTRACT

A sewer pipe cleaning apparatus including a sled-like skid means carrying a pipe shaft, which has one end constructed for connection to a source of high pressure fluid and the other end connected to a sewer cleaning nozzle which has a non-rotating base member, a rotatable turbine member rotatably mounted on the base member with a plurality of jet orifices, a bearing means mounted on the base member in abutting engagement with the turbine member, a non-rotating nose cone mounted on the base member for retaining the bearing means and rotatable turbine member in place on the base member, and a plurality of fluid passages are formed through the base member and turbine member for the transmission of high pressure fluid from the pipe shaft and through said passages and out said jet orifices, and also through the bearing means for cleaning the same.

5 Claims, 5 Drawing Figures

HIGH PRESSURE REVOLVING SEWER CLEANING NOZZLE

BACKGROUND OF THE INVENTION

1. Technical Field

The field of art to which this invention pertains may be generally located in the class of devices relating to sewer cleaning apparatuses. Class 134, U.S. Pat. Office Classification, appears to be the applicable general area of art to which the subject matter similar to this invention has been classified in the past.

2. Background Information

It is known in the sewer cleaning apparatus art to provide sewer cleaning apparatuses which employ high pressure cleaning nozzles, wherein the nozzle is either stationary or rotary. A disadvantage of the prior art non-rotating sewer cleaning nozzles is that they do not provide jet cleaning streams of water to be discharged over the entire inner surface of a sewer pipe. A disadvantage of the prior art rotating sewer cleaning nozzles is that they are subject to damage and being clogged up by dirt so that they cannot rotate.

U.S. Pat. No. 2,062,850 discloses a rotary cleaning nozzle mounted on a carriage which includes a plurality of runners designated by the letter K. U.S. Pat. No. 4,073,302 discloses a sewer pipe cleaning device comprising a non-rotating nozzle carried on a pair of sled-like skids 46. The following list of U.S. patents disclose further examples of prior art cleaning apparatuses for tubular articles namely, U.S. Pats. Nos. 649,839, 903,754, 1,126,553, 2,194,095, 2,218,130, 2,336,293, 3,370,599, 4,184,220 and 4,271,556.

SUMMARY OF THE INVENTION

In accordance with the present invention, a high pressure revolving sewer cleaning nozzle apparatus is provided which is compact and efficient in operation. The cleaning nozzle of the present invention includes a non-rotating defuser base which is mounted on a sled-like skid member. A rotating turbine member is rotatably mounted on the defuser base by a bearing means which includes water-cleaned ball thrust bearing, and it is retained in place by a nose cone or head member which is releasably secured to the defuser base. The turbine member is provided with a plurality of turbine blades. High pressure water enters the defuser base and is directed through a plurality of offset openings onto the turbine blades and exits through multiple jet orifices which point rearward and outward. The jet streams of water exiting from the rotating turbine causes all areas of the sewer pipe in which the nozzle is operated to be scoured and efficiently cleaned while at the same time providing a propelling force to carry the cleaning nozzle apparatus and hose through the sewer pipe. An advantage of the cleaning nozzle apparatus of the present invention is that the jet streams of water emitted by the rotating turbine member contacts the entire inner surface of the sewer pipe and moves the sludge and other debris rearwardly with a spiral action. The ball thrust bearing structure is such that the rotating turbine member rides on a film of high pressure water and is constantly being cleaned and flushed of dirt. The rotating assembly is also being constantly flushed and cleaned.

DESCRIPTION OF THE PREFERRED EMBODIMENT

Figure 1:
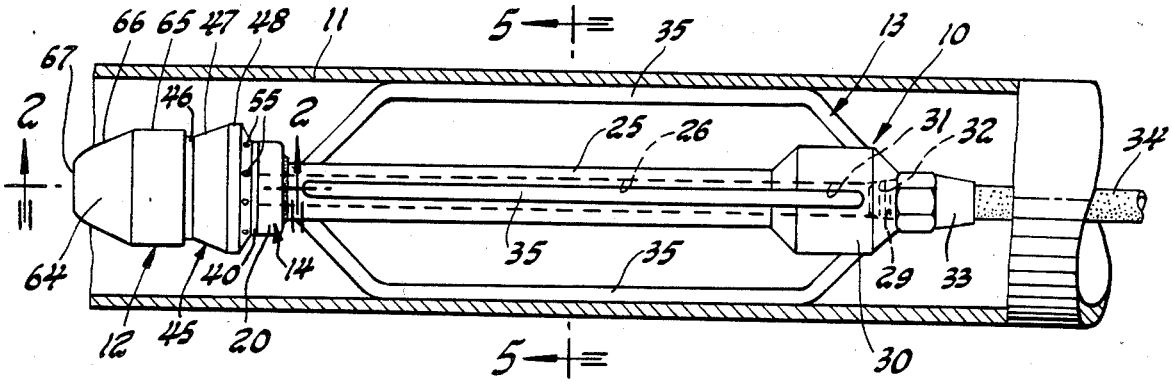
FIG. 1 is a vertical section view of a typical sewer pipe showing the high pressure revolving sewer cleaning nozzle of the present invention in a position of use in the pipe.

Referring now to the drawings, the numeral 10 generally designates a high pressure revolving sewer pipe cleaning apparatus constructed in accordance with the principles of the present invention. In FIG. 1, the apparatus 10 is shown in a typical position of use during a sewer pipe cleaning operation, in a sewer pipe 11 which is normally buried some distance below the surface of the ground. Access for inserting the apparatus 10 in the pipe 11 would be through a conventional sewer manhole.

The sewer cleaning apparatus 10 includes a non-rotating nose cone, generally indicated by the numeral 12, which is carried on a non-rotating defuser base 14, which in turn is operatively mounted on a sled-like skid means, generally indicated by the numeral 13.

Figure 2:
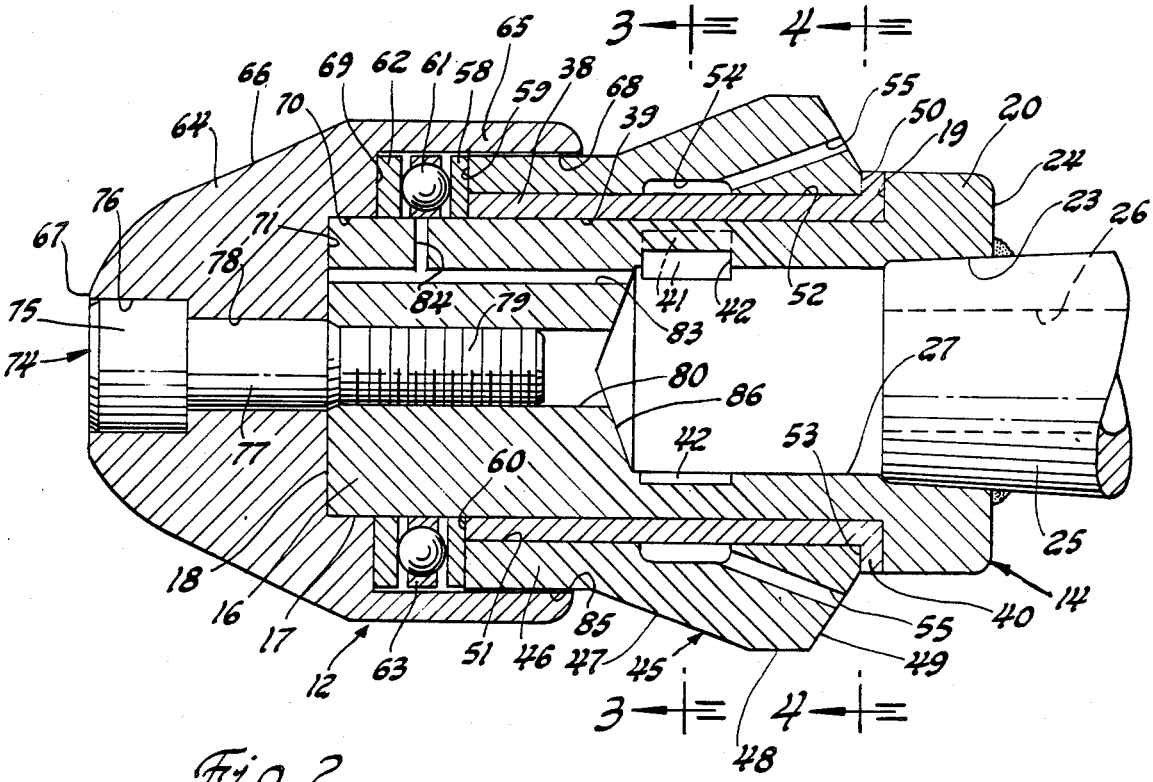
FIG. 2 is an enlarged, elevation section view of the nozzle structure illustrated in FIG. 1, taken along the line 2—2 thereof, and looking in the direction of the arrows.
Figure 3:
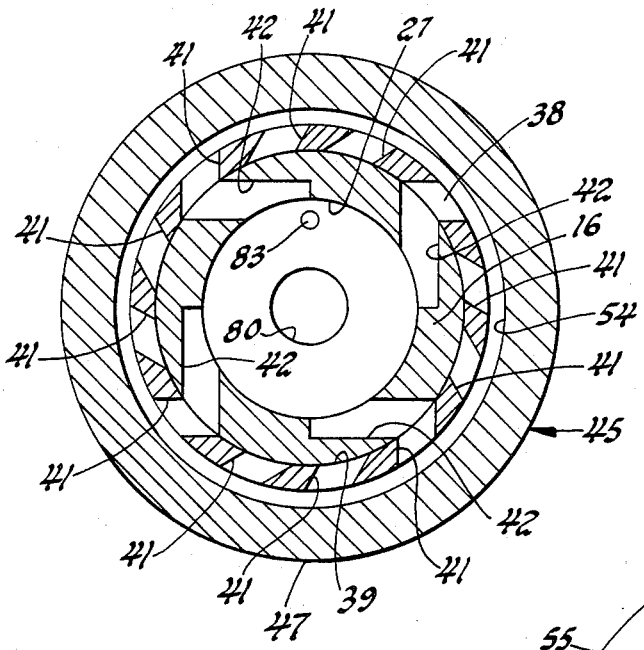
FIG. 3 is an elevation section view of the nozzle structure illustrated in FIG. 2, taken along the line 3—3 thereof, and looking in the direction of the arrows.

As shown in FIGS. 2 and 3, the non-rotating defuser base 14 includes a cylindrical body 16 which has a cylindrical periphery 17 and a transverse flat front end 18 (FIG. 2). The defuser base 14 is further provided with an integral, transverse annular flange 20 on the rear end thereof, which has a transverse flat shoulder surface or face 19 on the front or inner end thereof, which terminates at its inner end at the body periphery 17 and at its outer end with the circular periphery of the flange 20. The defuser base flange 20 is provided with a transverse flat rear face 24 through which is formed an inwardly and forwardly extended conical or tapered bore 23.

As best seen in FIG. 2, the front tapered end of a pipe shaft 25 is fixedly mounted in the conical bore 23 in the defuser base flange 20, by any suitable means, as by welding. The pipe shaft 25 in one embodiment was a one inch diameter pipe. As shown in FIGS. 1 and 2, the pipe shaft 25 is provided with an axial bore or passage 26 for the flow of pressurized, as for example, water at 1800 pounds per square inch pressure. As best seen in FIG. 2, the defuser base body 16 includes an inwardly extended, large axial bore 27 which commences at the inner end of the conical bore 23 and extends inwardly to about an intermediate point in the length of the defuser body 16.

As shown in FIG. 1, a cylindrical balancing weight member 30 is fixedly attached to the rear end of the pipe shaft 25 by any suitable means, as by welding. A bore or passage 31 is formed through the balancing weight member 30, and the forward end thereof communicates with the bore 26 in the pipe shaft 25. The rear end of the bore 31 is provided with a tapered pipe thread, as indicated by the numeral 32, in which is operatively mounted a male pipe fitting 29. Threadably mounted on the outer end of the pipe fitting 29 is a female pipe fitting 33 on an end of a high pressure water supply hose 34.

Figure 5:
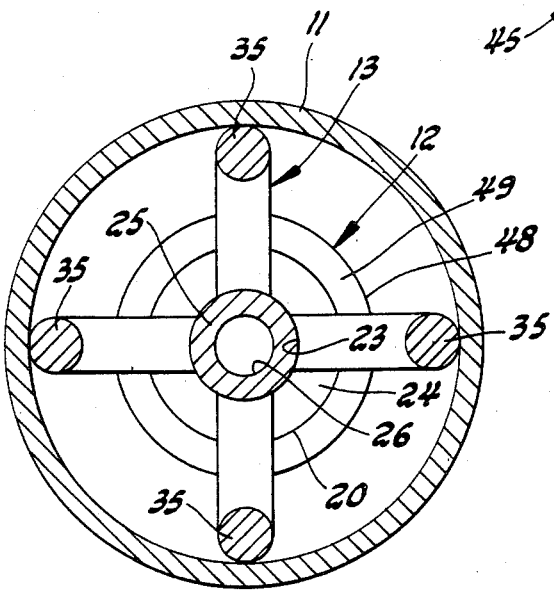
FIG. 5 is an enlarged, elevation section view of the structure illustrated in FIG. 1, taken along the line 5—5 thereof, and looking in the direction of the arrows.

The sled-like skid means 13 comprises a plurality of skid rods 35 as shown in FIGS. 1 and 5. Each of the skid rods 35 has a longitudinal central portion and integral end portions which angle inwardly. The inwardly angled rod end portion at the forward end of each rod 35 is fixedly secured to the front end of the pipe shaft 25 by any suitable means, as by welding. The inwardly angled rear end portions of the rods 35 are fixedly secured to the outer surface of the balancing weight member 30 by any suitable means, as by welding. Each of the skid rods 35 functions as a sled runner.

Figure 4:
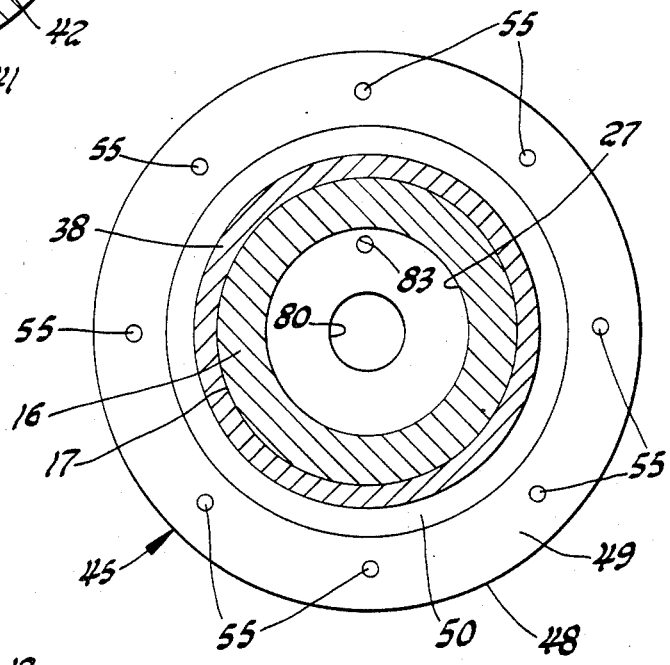
FIG. 4 is an elevation section view of the nozzle structure illustrated in FIG. 2, taken along the line 4—4 thereof, and looking in the direction of the arrows.

As shown in FIGS. 2 through 4, a bronze cylindrical bushing 38 is rotatably mounted on the outer peripheral, cylindrical surface 17 of the defuser base body 16. The numeral 39 designates a cylindrical, interior bore through the bushing 38. The bushing 38 is rotatably mounted on the peripheral surface 17 of the defuser base body 16. The bushing 38 is provided on its rear end with an integral, radial, outwardly extended, annular flange 40 which has its outer or rear face rotatably seated against the inner or front transverse face 19 of the defuser base 20. As shown in FIG. 3, the bushing 38 is provided with a plurality of evenly spaced apart transverse slots 41, the walls of which function as turbine blades. In one embodiment there were twelve slots 41 functioning as twelve turbine blades. As shown in FIG. 3, the turbine slots 41 are adapted to be connected to the high pressure water flowing through the pipe shaft bore 26 by means of the bore 27 and a plurality of transverse slots 42 which are formed through the body 16 of the defuser base 14. The slots 42 are tangentially disposed relative to the axial bore 27, with the inner ends communicating with the bore 27. The outer end of the slots 42 communicate with the inner ends of the turbine slots 41. The turbine slots 41 are disposed in the bushing 38 at right angles to the axis of the slots 42.

As best seen in FIG. 2, the numeral 45 generally designates a rotary jet member or turbine. The rotary turbine 45 has a front end cylindrical portion 46 which comprises about one third of the length thereof. The rotary turbine 45 has a longitudinal central portion which has an outer periphery that angles outwardly and rearwardly, as indicated by the numeral 47. The periphery 47 may also be called an outwardly diverging periphery, which terminates at its front end with the cylindrical portion 46, and at its rear end with a cylindrical, peripheral, longitudinal portion 48. The cylindrical longitudinal turbine outer periphery 48 terminates at its rear end with a rearwardly and radially inward sloping or converging surface 49. The rear converging periphery 49 terminates at its radial inner end with a transverse, straight, rear end surface 50. The rotary turbine 45 has an axial bore 51 formed therethrough, through which is fixedly mounted, by any suitable means, as by a press fit, the bronze bushing 38. The outer periphery 52 of the bushing 38 is seated in the axial bore 51, in the rotary turbine 45, by the aforementioned press fit. The transverse or radial rear end 50 of the rotary turbine 45 seats on the front transverse surface 53 of the bushing flange 40.

As shown in FIGS. 2 and 3, the rotary turbine 45 is provided with an annular groove 54, which is formed in the longitudinal axial bore 51, and in a position longitudinally aligned with the turbine slots 51 and the slots 42 in the defuser base body 16. As shown in FIGS. 2 and 4, a plurality of bores 55 are formed in the rear end of the rotary turbine 45. The bores 55 function as jet orifices and they are angled radially outward, and rearwardly, with their front ends communicating with the annular groove 54 and their rear ends emerging from the converging rear end periphery 49. As shown in FIG. 4, the jet orifice bores 55 are evenly spaced around the rotary turbine 45, and they form a circular pattern, so that high pressure streams of water emerging therefrom causes all areas of a sewer pipe to be scoured, while at the same time furnishing a forward propelling force to carry the sewer cleaning apparatus 10, and the hose 34, forwardly through a sewer pipe, such as a sewer pipe 11.

As shown in FIG. 2, the pipe cleaning apparatus 10 includes a ball thrust bearing assembly which comprises a rear annular thrust washer or ring 58. The thrust washer 58 has its rear face seated against the front end faces 59 and 60 of the rotary turbine 45 and the bushing 38, respectively. The ball bearing assembly further includes a plurality of roller bearings 61 which are carried in a conventional ball bearing race or carrier 63. The thrust bearing assembly further includes a front annular thrust washer or ring 62 which is seated on the front side of the ball bearings 61. The last described ball bearing assembly is seen as being seated around the cylindrical periphery 17 of the front end 16 of the defuser base 14.

As shown in FIG. 2, the roller thrust bearing assembly is releasably secured in place by the nose cone 12. As shown in FIG. 2, the nose cone 12 has a front end portion 64, and an integral rear end cylindrical portion 65 which is seated over the thrust bearing assembly and the front end of the rotary turbine 45. The nose cone front end 64 has a conically shaped outer periphery 66 which slopes forwardly and curves inwardly to a meeting place with a front transverse front end 67. The cylindrical rear end 65 of the nose cone 12 has an inwardly extended bore 68 which terminates at an inner transverse or radial wall 69. The front end of the thrust bearing washer 62 seats against the nose cone bore wall 69. The nose cone 12 has a reduced diameter, inwardly extending bore 70 which extends longitudinally forwardly from the first bore end wall 69 and terminates at a transverse flat radial wall 71. The last mentioned bore 70 receives the forward inner end of the cylindrical body portion 16 of the base 14. The front end 18 of the base body front end seats against the bore end wall 71.

As shown in FIG. 2, the entire cleaning nozzle structure is releasably secured in place on the defuser base 20 by a suitable retainer machine screw, generally indicated by the numeral 74. The retainer screw 74 is provided with an enlarged head 75 which is seated in a first portion 76 of an axial bore formed through the nose cone 12. The retainer screw 74 includes an integral screw body 77 which is adapted to be seated in a reduced diameter 78 which communicates with the first mentioned bore 76. The inner end of the reduced diameter bore 76 communicates with a threaded axial bore 80 which is formed through the front end body 16 of the defuser base 14. The retainer screw 74 also includes a threaded inner end 79 which is adapted to be threadably mounted in the threaded bore 80, in the base 14, for securing the rotary turbine 45, and its bushing 36, and the thrust bearing assembly in an operative position on the base 14.

As shown in FIGS. 2, 3 and 4, an axial bore 83 is formed through the front end of the defuser base body 16, with its rear end communicating with the high pressure water in the bore or chamber 27. A transverse bore 84 is also formed through the defuser base body 16, with its rear end communicating with the longitudinal bore 83, and its outer end terminating at the outer periphery 17 of the defuser body 16. As shown in FIG. 2, the outer periphery 85 of the rotary turbine front end portion 46 is spaced apart from the bore 68 formed in the rear end 65 of the nose cone 12 to permit a flow of pressurized water through the bores 83 and 84, and to flush the thrust bearing assembly, and then pass outwardly and rearwardly through the clearance between the rotary turbine outer periphery surface 85 and the bore 68. The water hose 34 would comprise a hose as long as desired to run through a particular length of pipe 11, and it would be connected to a source of high pressure water or other cleaning fluid.

In use, the sewer cleaning apparatus 10 would be placed in the sewer pipe 11 at a manhole intersection or other pipe access point. The hose 34 is then connected to the pipe fitting 29 on the rear end of the skid means, after which the operator or workman retreats from the manhole, and the water pressure is turned on to be discharged from the jet orifices 55. A high water pressure, such as 1800 pounds per square inch, is employed. The force of the high pressure water striking the inner end wall 86 of the chamber 27 and the inner end of the machine screw 74, plus the reaction of the jet streams emerging from the jet orifices 55 drives the sewer cleaning apparatus 10 forward. The speed of movement of the sewer cleaning apparatus 10 through the pipe 11 may be controlled by controlling the tension on the hose 34. The high pressure water passes from the hose 34 and into the chamber 27, and then radially and tangentially outward through the slots 42 and against the sidewalls of the angularly disposed turbine slots 41 to rotate the turbine 45 counterclockwise, as viewed in FIG. 3. The high pressure water flows through the turbine slots 41 and into the annular chamber 54 and thence out through the jet orifices 55, to rotate the turbine 45, and to contact the entire pipe inner surface, and move the sludge and other debris with a spiral action rearward.

The sled-like skid means 13 functions to maintain the nozzle end of the apparatus 10 in a central position in the pipe 11. The ball bearing assembly is continuously flushed by high pressure water, and it will be seen that the rotating assembly of the bushing 38 and the turbine 45 rides on a film of high pressure water. High pressure water flows from the chamber 27 and out through the bores 83 and 84, and thence through the ball bearing assembly, and thence out through the space between the inner bore 68 of the nose cone cylindrical portion 65 and the outer surface 85 of the front end of the turbine 45, so as to constantly clean and flush outward any dirt or sludge that may get into the ball bearing assembly. The water exiting through the close fitting between the outer surface 85 of the turbine 45 and the bore 68 of the cylindrical portion 65 of the nose cone 12 prevents any harmful sewer debris from entering the internal mechanism of the nozzle.

What is claimed is:

1. A sewer pipe cleaning apparatus, for cleaning the interior of a sewer pipe, including a skid means carrying a pipe shaft which has one end constructed for connection to a source of high pressure fluid and the other end connected a sewer cleaning nozzle, characterized in that said nozzle comprises:

(a) a non-rotating base member having a longitudinal axis, and having one end fixedly connected to said other end of the pipe shaft;

(b) a rotatable turbine member rotatably mounted on the base member about the longitudinal axis of the base member, and having a front end and a rear end, and having a plurality of jet orifices formed on the rear end thereof, and each of said jet orifices is inclined toward the rear end of the turbine member, at an acute angle relative to the longitudinal axis of the base member;

(c) a bearing means mounted on the base member and in an operative abutting engagement with one end of said turbine member;

(d) a non-rotating nose cone mounted on said base member for retaining said bearing means and rotatable turbine member on the base member;

(e) said base member and turbine member having fluid passages formed therethrough, for the transmission of high pressure fluid from said pipe shaft and through said passages and out said jet orifices, for cleaning discharge against the inner surface of a sewer pipe and for rotating the turbine member and moving the cleaning apparatus through the sewer pipe; and, (f) retainer means for releasably securing said nose cone on said base member.

2. A sewer pipe cleaning apparatus as defined in claim 1, characterized in that:

(a) said turbine member includes a bushing member, longitudinally fixed therein for rotatably mounting the turbine member on the base member.

3. A sewer pipe cleaning apparatus as defined in claim 2, characterized in that:

(a) said fluid passages formed through said base member includes a chamber formed along said longitudinal axis and having a periphery and having one end connected in communication with said other end of the pipe shaft, and said fluid passages further including a plurality of slots which communicate with said chamber and are evenly spaced apart about the periphery of said chamber; and, (b) said fluid passages formed through the turbine member include, a plurality of turbine slots formed through said bushing and communicating with the plurality of slots in the base member and with an annular groove in the turbine member, and said annular groove communicates with said plurality of jet orifices.

4. A sewer cleaning apparatus as defined in claim 3, characterized in that:

(a) said nose cone includes a cylindrical portion which extends over said bearing means and over said one end of said turbine member; and, (b) a fluid passage is formed through said base member and communicates at one end with said axial chamber and at the other end with said bearing means, whereby fluid under pressure is transmitted from said axial chamber in the base member and through said bearing means for cleaning dirt from the same, and then out between said nose cone cylindrical portion and said one end of the turbine member.

5. A sewer pipe cleaning apparatus as defined in claim 4, characterized in that:

(a) said bearing means is a roller bearing means.

* * * * *